US007451510B2

(12) United States Patent
Lee

(10) Patent No.: US 7,451,510 B2
(45) Date of Patent: Nov. 18, 2008

(54) WASHING MACHINE AND METHOD OF PERFORMING SPINNING OPERATION

(75) Inventor: Phal Jin Lee, Jinhae-si (KR)

(73) Assignee: LG Electronics, Inc., Seoul (KR)

( * ) Notice: Subject to any disclaimer, the term of this patent is extended or adjusted under 35 U.S.C. 154(b) by 721 days.

(21) Appl. No.: 10/888,023

(22) Filed: Jul. 12, 2004

(65) Prior Publication Data

US 2005/0016227 A1 Jan. 27, 2005

(30) Foreign Application Priority Data

Jul. 25, 2003 (KR) ..... 10-2003-0051511
Jul. 25, 2003 (KR) ..... 10-2003-0051512
Oct. 16, 2003 (KR) ..... 10-2003-0072247

(51) Int. Cl.
*D06F 35/00* (2006.01)

(52) U.S. Cl. ..... 8/158

(58) Field of Classification Search ..... 8/158, 8/159; 68/12.04, 12.06, 23.1
See application file for complete search history.

(56) References Cited

U.S. PATENT DOCUMENTS 4,488,235 A * 12/1984 Miller ..... 701/3
4,513,464 A * 4/1985 Rettich et al. ..... 8/159
5,301,523 A * 4/1994 Payne et al. ..... 68/12.16
6,510,715 B1 * 1/2003 Simsek ..... 68/12.06
2002/0016997 A1 * 2/2002 Jonsson ..... 8/159
2002/0046581 A1 * 4/2002 Shimakage et al. ..... 68/12.04

* cited by examiner

*Primary Examiner*—Frankie Stinson
*Assistant Examiner*—Samuel A Waldbaum
(74) *Attorney, Agent, or Firm*—McKenna Long & Aldridge LLP

(57) ABSTRACT

A method of performing a spinning operation of a washing machine is disclosed. First, a load weight of wet clothes contained in a tub is measured, and an optimal acceleration rate is calculated based upon the measured load weight. Finally, a rotational speed of the tub is gradually increased up to a predetermined speed at the calculated optimal acceleration rate such that the unbalanced distribution of the wet clothes within the tub is minimized.

7 Claims, 6 Drawing Sheets

WASHING MACHINE AND METHOD OF PERFORMING SPINNING OPERATION

This application claims the benefit of Korean Applications No. P2003-51511 filed on Jul. 25, 2003, P2003-51512 filed on Jul. 25, 2003, and P2003-72247 filed on Oct. 16, 2003, which are hereby incorporated by reference.

BACKGROUND OF THE INVENTION

1. Field of the Invention

The present invention relates to a washing machine, and more particularly, to a method of performing a spinning operation for a washing machine.

2. Discussion of the Related Art

Generally, a washing machine performs washing by executing a washing operation, a rinsing operation, and a spinning operation. The spinning operation includes a load pre-balancing cycle, a load weighing cycle, a load balancing cycle, and a main spinning cycle.

According to the principles of the related art, before the main spinning cycle, a microprocessor determines a load weight of wet clothes to measure spinning operation parameters, which helps to balance the load in the tub. However, it is very likely that some wet clothes in the washing machine become tangled one another by a nature of the mechanism of a drum washing machine. Consequently, an unevenly distributed load of the clothes in the washing machine creates an unnecessary moment about the center of a tub, which makes the motor irregularly rotate. For example, when a chunk of the wet clothes spins from a top to a bottom of the tub in the washing machine, the moment created by a gravity of the chunk forcibly rotates the motor over its limit. On the other hand, when the chunk spins from the bottom to the top, it creates an opposite rotational force that prevents the motor from rotating in the right direction. Therefore, the entanglement of the clothes causes a vibration of the tub, a nose, and a walking of the washing machine, all of which resulted in inaccuracy of the load weight of the wet clothes. As a result, the inaccurate load weight causes the inaccurate spinning operation parameters, which influence a performance of the main spinning operation.

According to the principles of the related art, after the load weighing cycle, the rotational speeds up the tub with a constant acceleration regardless of the load weight to perform the load balancing cycle. Speeding with the constant acceleration has caused a problem of the vibration of the tub, the walking of the washing machine, and the poor performance of the main spinning cycle. For example, if 10 kg clothes are not evenly distributed and a relatively low speed is used to redistribute them, it will be very difficult for the relatively low speed to not only balance the 10 kg load evenly but also reach a desired speed quickly. So to speak, the 10 kg unbalanced load creates the moment about the center of the tub. The moment then causes the vibration of the motor, the noise, the walking of the washing machine, and a lagging of the cycle. Thus, the load balancing cycle needs to last longer, meaning that more power is needed and inefficiency of the spinning operation is occurred.

During the load balancing cycle, the microprocessor determines an unbalancing value, which represents how irregularly the load of the wet clothes is distributed in the washing machine. Even though the microprocessor determines whether the main spinning operation can be carried out dependent upon the unbalancing value, the load is not likely to be evenly balanced for the smooth performance of the main spinning cycle because the unbalanced distribution levels are determined below a resonance frequency range. It is realized that the unbalanced distribution levels alter prominently within the resonance frequency range. Therefore, the unbalance load determined below the resonance frequency range is not accurate, which influences the performance of the main spinning cycle.

SUMMARY OF THE INVENTION

Accordingly, the present invention is directed to a washing machine that substantially obviates one or more problems due to limitations and disadvantages of the related art.

An object of the present invention is to provide more accurate washing parameters such as load weight of wet clothes, acceleration rates while balancing a load of the wet clothes, and to minimize the unbalanced distribution level of the wet clothes within a tub so that the performance of the spinning operation can be improved.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a method of controlling a spinning operation of a washing machine includes the steps of measuring the load weight of the wet clothes contained in the tub to be spun, determining an optimal acceleration rate based upon the measured load weight, and increasing a rotational speed of the tub to a first predetermined speed at the optimal acceleration rate in order to minimize unbalanced distribution of the wet clothes within the tub.

In another aspect of the present invention, a method of controlling a spinning operation of a washing machine includes the steps of measuring a load weight of wet clothes contained in a tub to be spun, selecting at least two distinct optimal acceleration rates if the measured load weight belongs to a particular acceleration range, and increasing the rotational speed of the tub to a first predetermined speed at the selected optimal acceleration rates alternately in order to minimize unbalanced distribution of the wet clothes within the tub.

In another aspect of the present invention, a method of controlling a spinning operation of a washing machine includes the steps of measuring a load weight of wet clothes contained in a tub to be spun, determining an optimal acceleration rate based upon the measured load weight, and increasing a rotational speed of the tub to a first predetermined speed at the optimal acceleration rate in order to minimize unbalanced distribution of the wet clothes within the tub. The method further includes the steps of measuring an unbalanced distribution level of the wet clothes within the tub while rotating the tub at the first predetermined speed, and interrupting the spinning operation of the washing machine when the measured unbalanced distribution level is greater than a predetermined value.

In another aspect of the present invention, a method of controlling a spinning operation of a washing machine includes the steps of measuring a first unbalanced distribution level of wet cloths contained within the tub while rotating the tub at a first speed, and interrupting the spinning operation of the washing machine when the first unbalanced distribution level is greater than a first predetermined value. The method further includes the steps of measuring a second unbalanced distribution level of the wet clothes while rotating the tub at a second speed selected from a resonance frequency range of the washing machine, and interrupting the spinning operation of the washing machine when a difference between the first and second unbalanced distribution levels is greater than a second predetermined value.

In another aspect of the present invention, a method of controlling a spinning operation of a washing machine includes the steps of measuring a load weight of the wet clothes contained in a tub to be spun, determining an optimal acceleration rate based upon the measured load weight, and increasing the rotational speed of the tub to a first speed at the optimal acceleration rate in order to minimize unbalanced distribution of the wet clothes within the tub. The method further includes the steps of measuring a first unbalanced distribution level of the wet clothes while rotating the tub at the first speed, interrupting the spinning operation of the washing machine when the first unbalanced distribution level is greater than a first predetermined value, measuring a second unbalanced distribution level of the wet clothes while rotating the tub at a second speed selected from a resonance frequency range of the washing machine, and interrupting the spinning operation of the washing machine when a difference between the first and second unbalanced distribution levels is greater than a second predetermined value.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings. Wherever possible, the same reference numbers will be used throughout the drawings to refer to the same or like parts.

Figure 1:
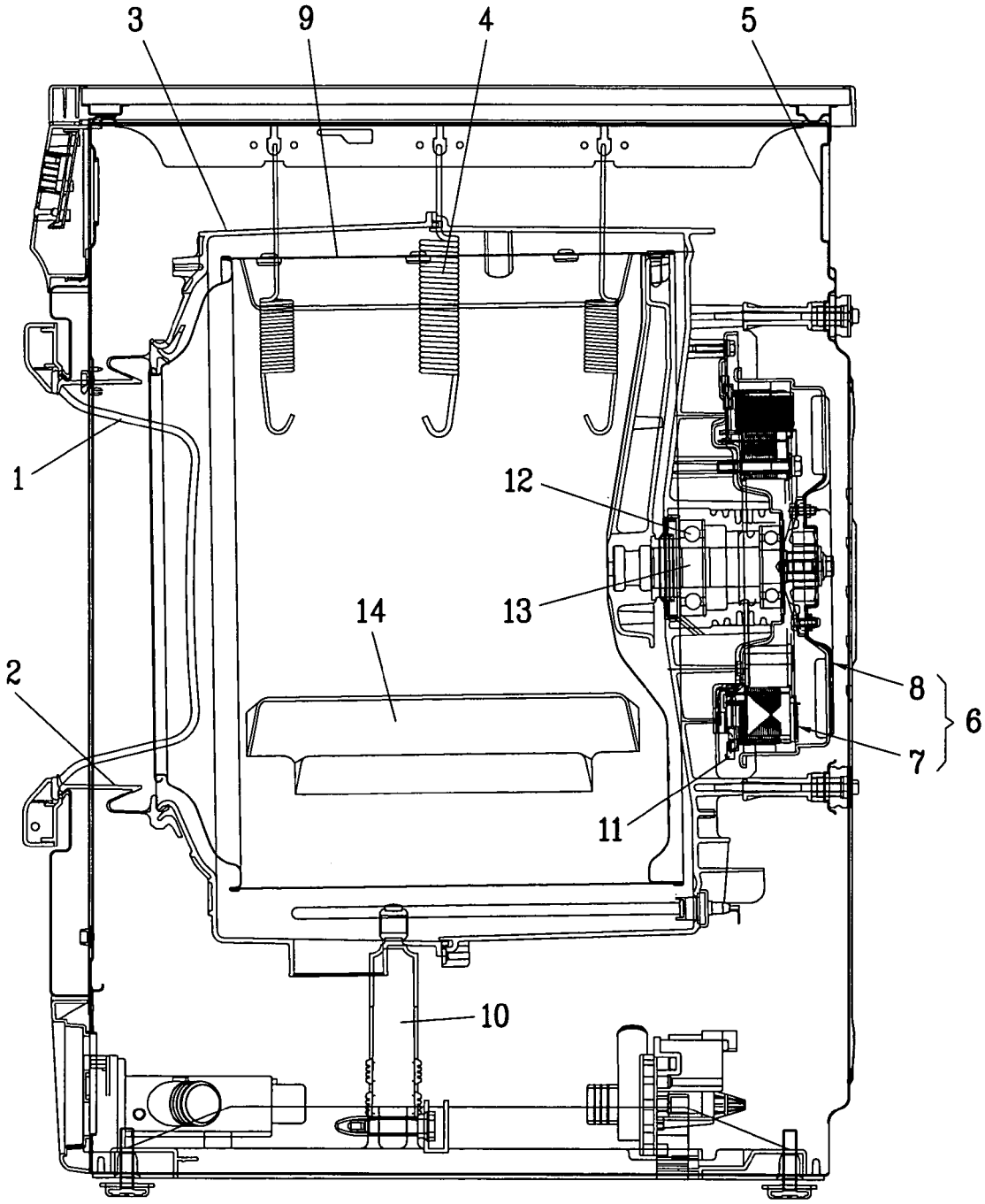
FIG. 1 illustrates a prospective side view of a washing machine in accordance with the present invention.

FIG. 1 illustrates a prospective side view of a washing machine in accordance with the present invention. According to FIG. 1, the washing machine includes a cabinet 5, a tub 3, and a drum 9. The drum 9 includes a drum axle 13, which transmits a driving force of a DC motor 6 to the drum 9. For smooth operation of the motor 6, the drum axle 13 is equipped with bearings 12 at its both ends, which are placed in a bearing housing (not illustrated). The motor 6 itself contains a stator 7 and a rotor 8 which is directly connected to the drum 9 and rotates it. The washing machine also includes a hanging spring 4 which functions as a support between an inner top of the cabinet 5 and an outer top of the tub 3. In order to reduce vibration of the tub 3, the washing machine includes a friction damper 10 provided between an inner bottom of the cabinet 5 and the outer bottom of the tub 3. In addition, the washing machine includes a motor sensor 11 which measures a number of the rotor 8 rotation, which represents the speed of the motor 6.

Figure 2:
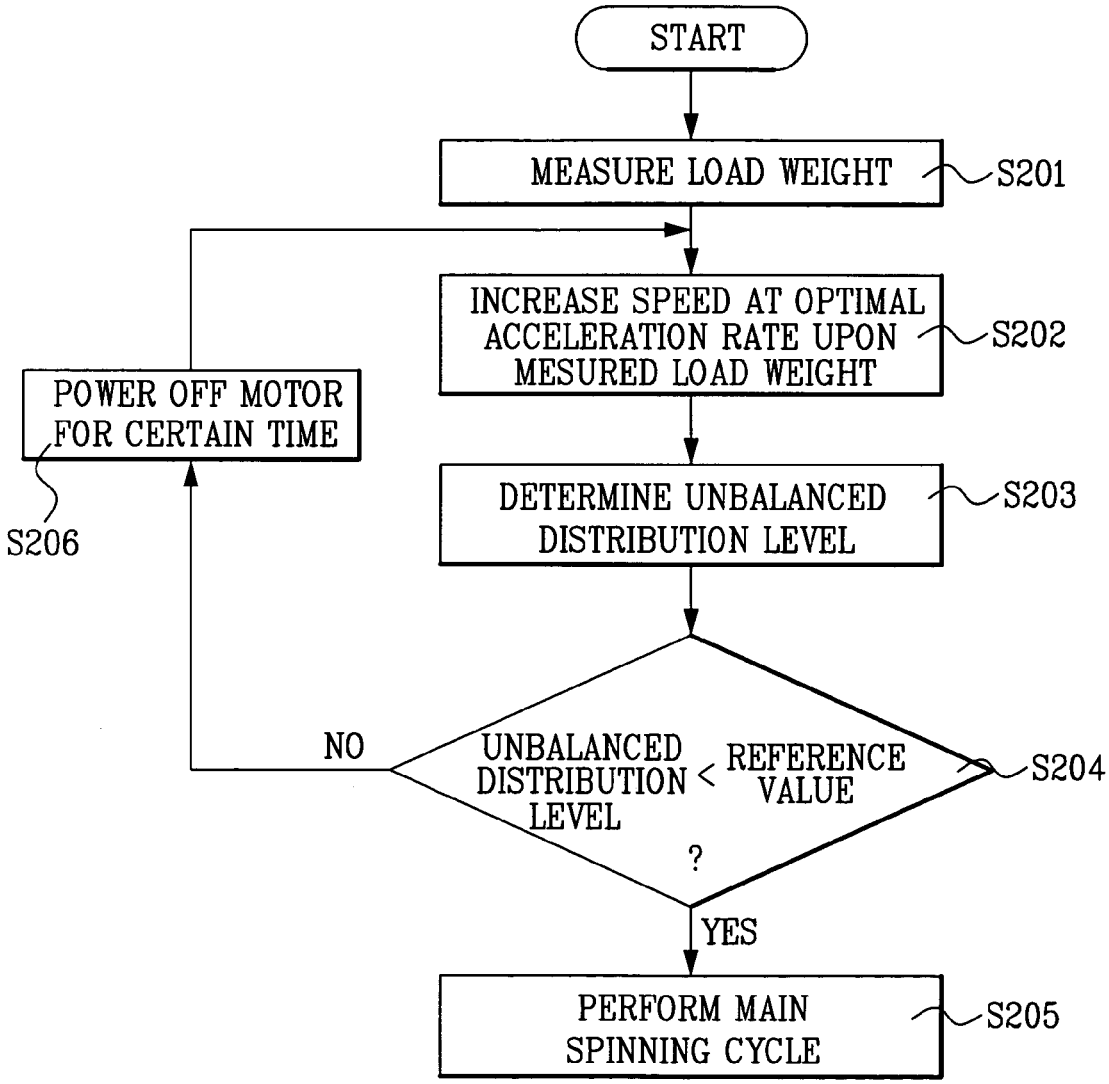
FIG. 2 is a flowchart illustrating one embodiment of the method of controlling a spinning operation of the washing machine in accordance with the present invention.

FIG. 2 is a flow chart illustrating a method of controlling a spinning operation of the washing machine shown in FIG. 1 according to one embodiment of the present invention. According to FIG. 2, a microprocessor (not illustrated) of the washing machine initially increases the rotational speed of the tub 3 from zero to a second predetermined speed. It then measures an acceleration time that it takes for the rotational speed to reach the second predetermined speed from zero.

Finally, it determines the load weight of the wet clothes based upon the measured acceleration (S201). Measuring the load weight of the wet clothes improves the performance of the washing machine by obtaining more accurate washing parameters. An example of the washing parameters is the acceleration rate at which the microprocessor increases the rotational speed. The microprocessor determines the optimal acceleration rate based on the measured load weight and increases the rotational speed at the determined optimal acceleration rate (S202).

According to the present invention, the corresponding acceleration rate now helps rebalance the load of the clothes so efficiently that it saves time and neither vibrates the tub 3 nor creates a noise. Thus, the load balancing cycle is shortened. Now, the motor 6 rotates at the corresponding acceleration rate to balance the load and the microprocessor determines the unbalanced distribution level, which represents how irregularly the load is distributed in the tub 3 (S203). If the unbalanced distribution level is less than the reference value (S204), then it moves onto the main spinning cycle to perform. (S205). Otherwise, the microprocessor interrupts the spinning operation and shuts off a power supply to the motor 6 that rotates the tub 3 for a predetermined time (S206) and goes back to the step of increasing the rotational speed at the determined optimal acceleration rate upon the measured load weight (S202).

Figure 3:
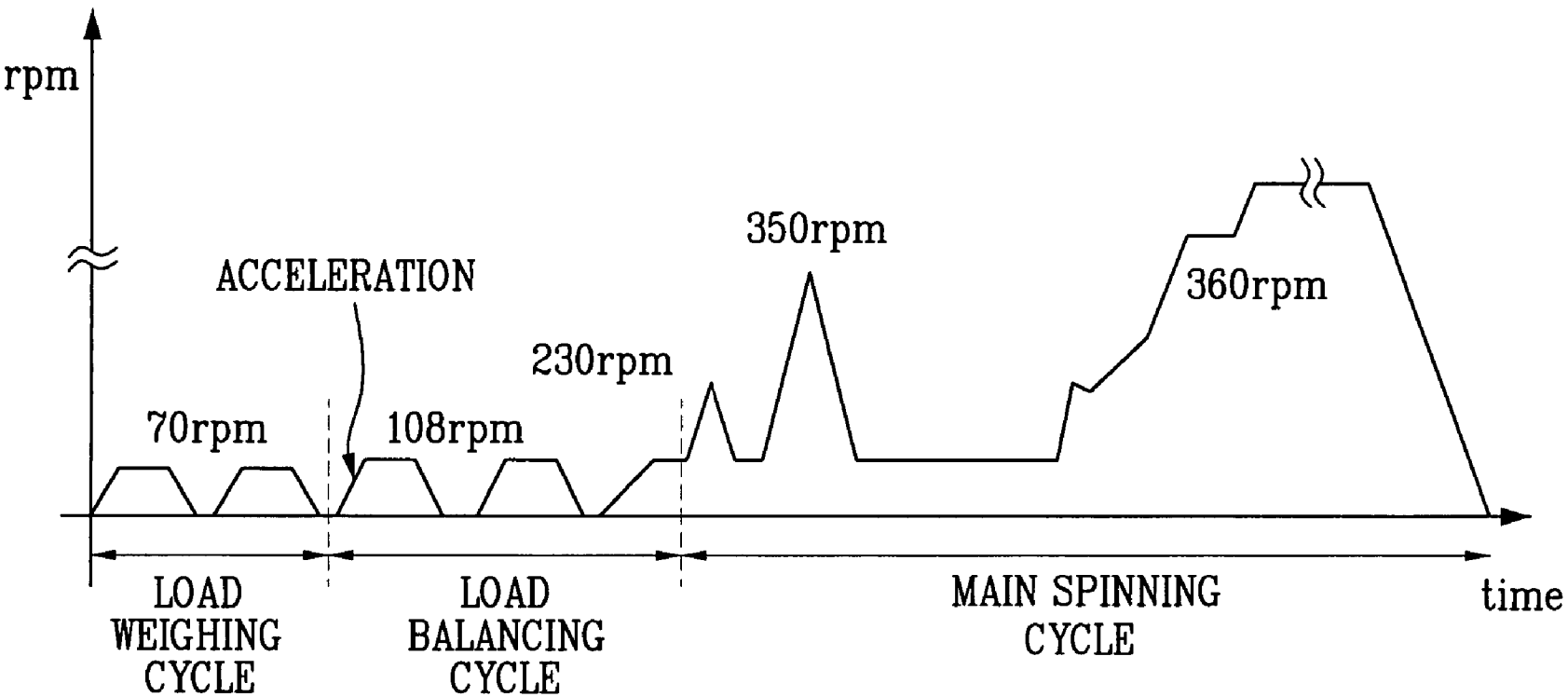
FIG. 3 is a graph illustrating a spinning operation of the washing machine including a load balancing cycle.

FIG. 3 is a graph illustrating a spinning operation including a determined optimal acceleration rate during a load balancing cycle in accordance with the present invention. During the load balancing cycle, the motor 6 rotates up to 108 RPM at the determined acceleration rate based upon the load measured weight. According to the present invention, table 1 below shows how the acceleration rate differentiates upon the load weight.

TABLE 1

Acceleration rate varies dependent upon load weight.

| Load Weight | Acceleration Rate (RPM/ms) |
|---|---|
| Light | 1/160, 1/190 (alternate rotation) |
| Medium Light | 1/150 |
| Medium Heavy | 1/180 |
| Heavy | 1/200 |

As tabulated in the table 1, the microprocessor determines the acceleration rate which corresponds to the load weight. A plurality of the acceleration rates is predetermined for a plurality of the load weight ranges. Each load weight range is assigned to a certain acceleration rate. Exceptionally, for the light load, the microprocessor alternately increases the rotational speed of the tub 3 to a predetermined speed by selecting the two determined optimal acceleration rates one by one in order to minimize the unbalanced distribution of the wet clothes within the tub 3. The acceleration rate noticeably varies as the load weight changes in order to optimize efficiency of the load balancing cycle. To be more specific, the acceleration rate is inversely proportional to the load weight. The acceleration rate helps to quickly lower the unbalanced distribution level. Then, it will proceed to the main spinning cycle if the unbalanced distribution level is less than the reference value. As a note, the unit of the acceleration rate is RPM/ms, meaning that the speed of the motor increases by 1 revolution per minute (RPM) in 1 millisecond.

Figure 4:
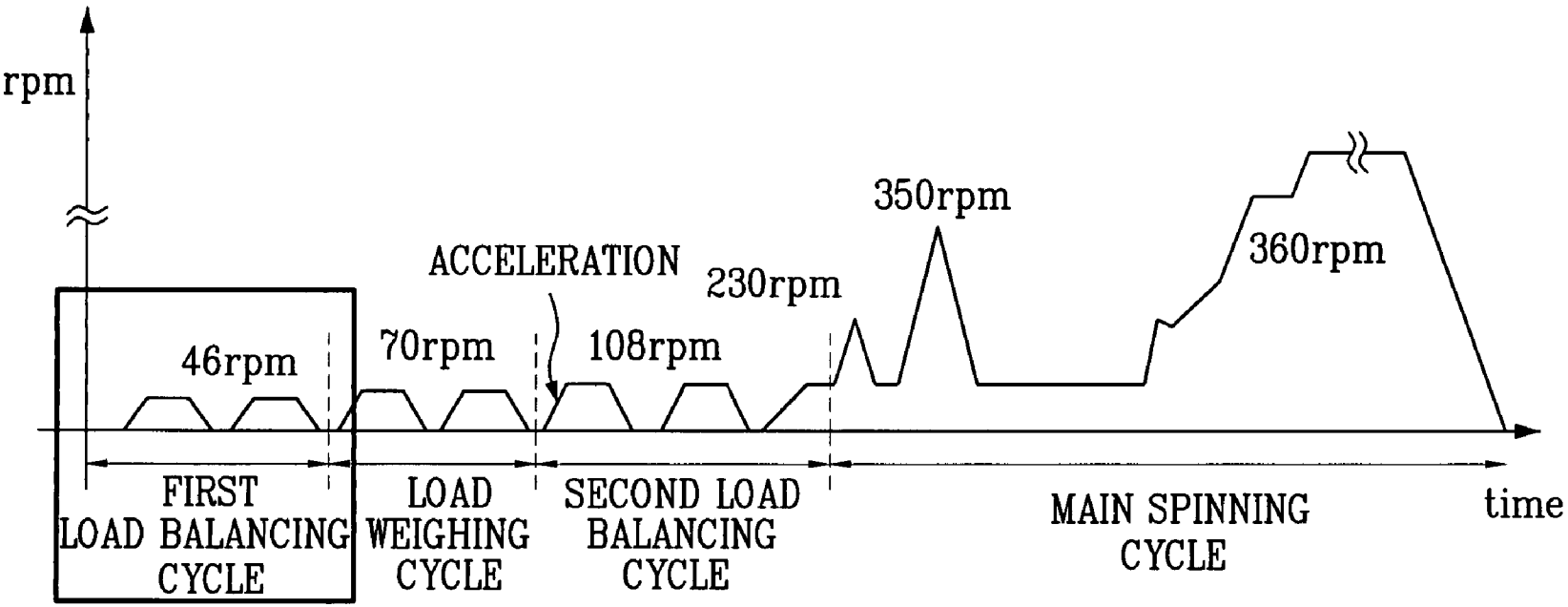
FIG. 4 is a graph illustrating a spinning operation of the washing machine including a first load balancing cycle and a second load balancing cycle.

In addition to the load balancing cycle specified above, it may include an additional step of a load balancing cycle prior to the load weighing cycle. The additional step helps to measure the load weight more accurately by reducing other side effects such as the vibration of the motor and the walking of the washing machine. For example, FIG. 4 is a graph illustrating a spinning operation including the additional step of a first load balancing cycle prior to the load weighing cycle, and a step of a second load balancing cycle with the determined acceleration rate. It is realized that the rotational speed needs to be approximately as low as 46 RPM due to the fact that below 50 RPM a gravity of the load prevails over a centrifugal force of the motor so that the load moves freely and gets balanced easily. During the first load balancing cycle, the motor alternately rotates with the load at the predetermined speed at least one cycle in each direction, a first direction and a second direction.

It is likely that at the predetermined speed the load reaches a top of the tub 3, it falls down to a bottom of the tub 3 due to the gravity, instead of sticking to a wall of the tub 3 and spinning with it by the centrifugal force. Fallen by the gravity, the unbalanced load is evenly spread out in the tub 3. For example, a heavy chunk of the tangled load is spinning around in the tub 3 causing the vibration of the motor. The microprocessor can spread out the heavy chunk of the tangled load by free-falling from the top and being hit on the bottom of the tub 3, continuously.

Figure 5:
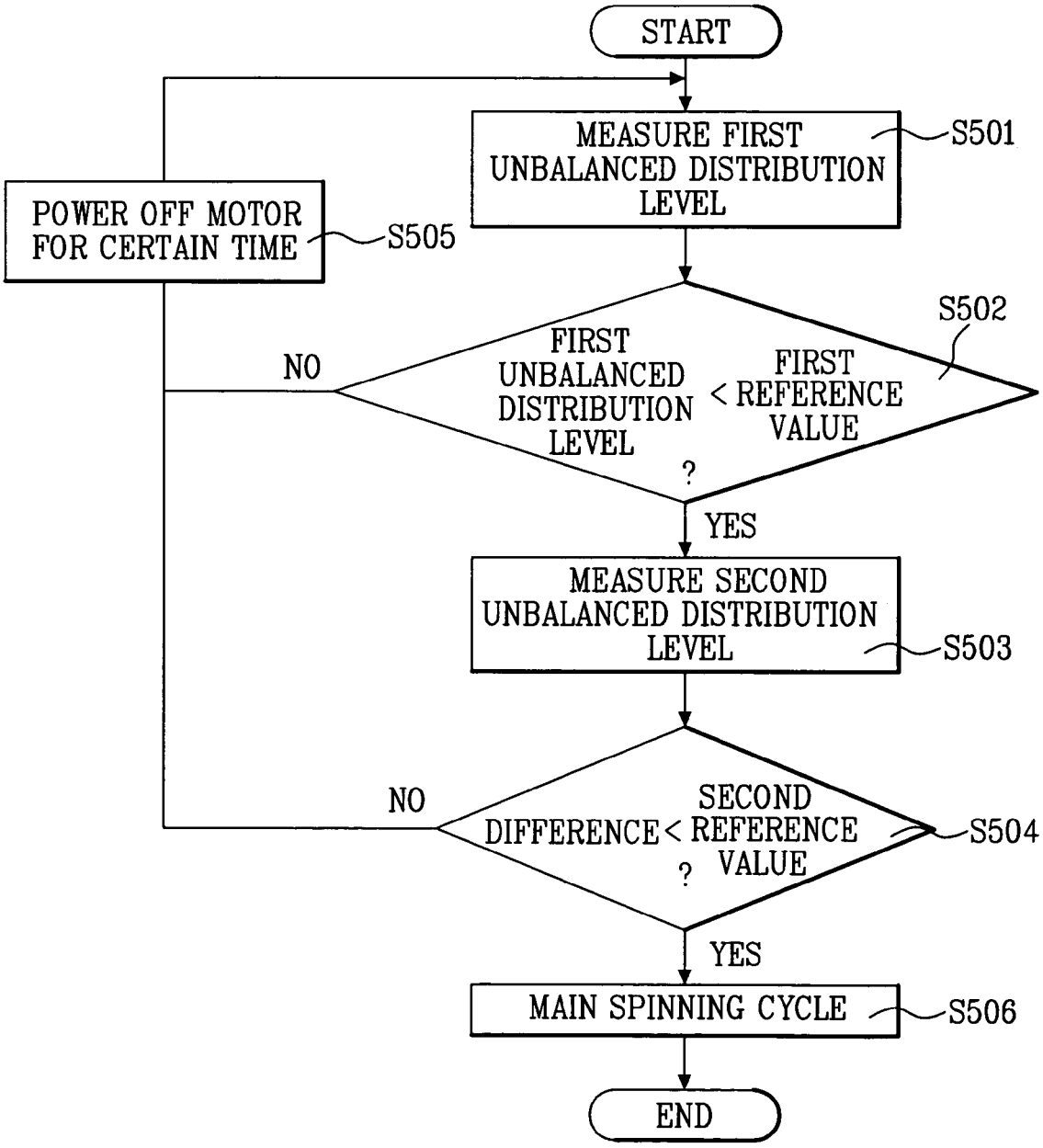
FIG. 5 is a flowchart illustrating another embodiment of the method of controlling a spinning operation of the washing machine in accordance with the present invention.

FIG. 5 is a flowchart illustrating a spinning operation including a plurality of unbalanced distribution levels in accordance with the present invention. The microprocessor measures a first unbalanced distribution level at a first speed below a resonance frequency range of the motor (S501). The resonance frequency range of the washing machine is usually from 170 rpm to 250 rpm and the main spinning cycle is frequently performed above 300 rpm. The first unbalanced distribution level is determined by measuring a speed variation of a motor that rotates the tub 3. For example, if the motor rotates at 100 rpm, the microprocessor measures how much the speed fluctuates at 100 rpm. It then determines if the first unbalanced distribution level is less than a first reference value (S502). It interrupts the spinning operation of the washing machine and shuts off the power supply to the motor 6 that rotates the tub 3 for a predetermined time when the first unbalance value is greater than a first reference value (S505). If the first unbalanced distribution level is less than the first reference value, the microprocessor measures a second unbalanced distribution level (S503). The important is that it measures the second unbalanced distribution level at a second speed selected from the resonance frequency of the washing machine.

Now, the microprocessor determines difference between the first unbalanced distribution level and the second unbalanced distribution level. It may calculate the difference by dividing the first unbalanced distribution level by the second unbalanced distribution level, as a ratio. Or, it may simply subtract one from the other. It then compares the difference to a second reference value to determine if the difference is less than the second reference value. (S504). It interrupts the spinning operation of the washing machine and shuts off the power supply to the motor 6 for the predetermined time when the difference is greater than the second reference value (S505). If the difference is less than the second reference value, then it proceeds to the main spinning cycle (S506).

Figure 6:
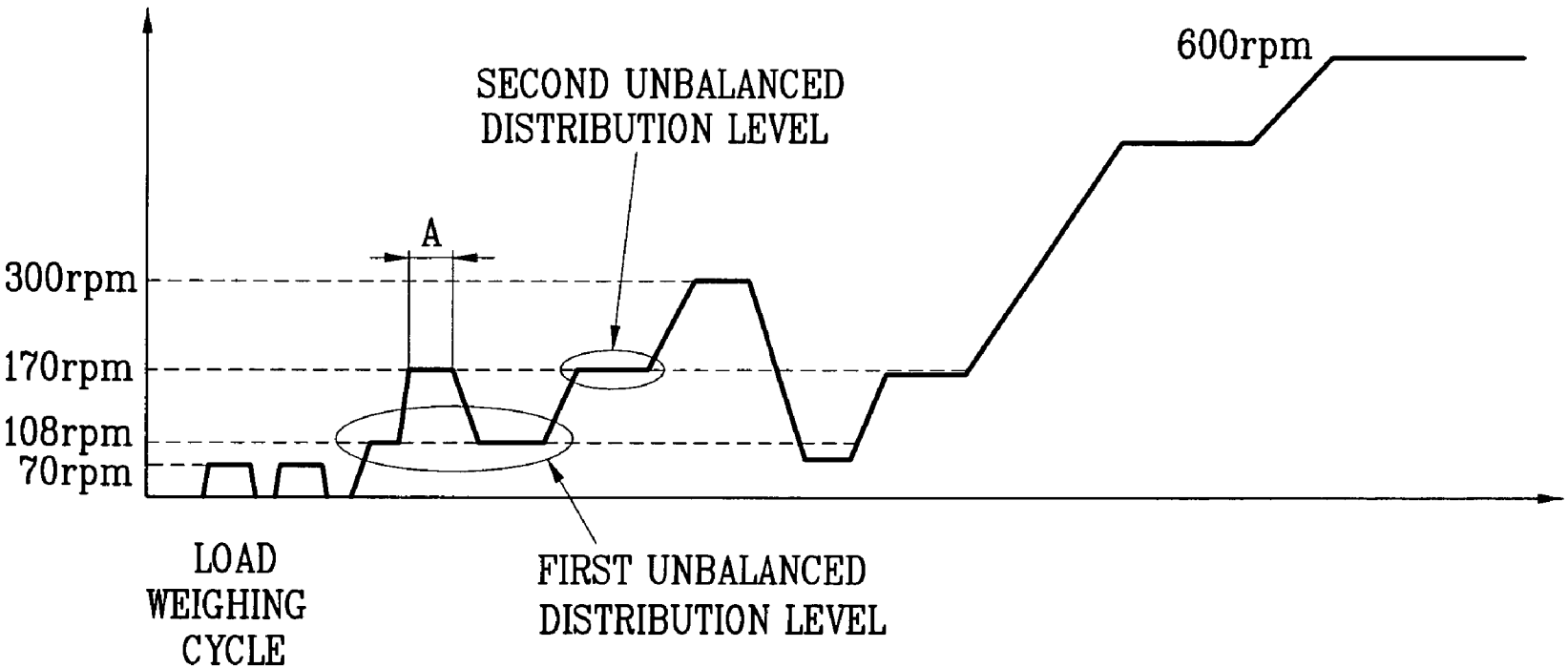
FIG. 6 is a graph illustrating a spinning operation of the washing machine, in which the unbalanced distribution level of the wet clothes is measured more than once.

FIG. 6 is a graph illustrating a spinning operation including a plurality of unbalanced distribution levels in accordance with the present invention. The present invention measures the plurality of unbalanced distribution levels. For example, as shown in FIG. 6, a first unbalanced distribution level is measured at 108 rpm below the resonance frequency range. "A" denotes a last minute drain-out stage during which the microprocessor speeds up the motor to 170 rpm for a predetermined time in order to drain out leftover water in the tub 3. If the first unbalanced distribution level is less than the first reference value, the microprocessor stores the first unbalance distribution level and determines a second unbalance distribution level at 170 rpm selected from the resonance frequency range.

As experimentally proved, the first unbalanced distribution level determined below the resonance frequency range is prominently different from the second one within the resonance frequency range. If proceeding to the main spinning cycle is determined based on the only first unbalanced distribution level, the washing machine will be unstably performed causing the vibration, walking of the washing machine, and noises from it. Determining a difference between the first and the second determined unbalanced distribution levels and considering it as the unbalanced distribution level, the present invention obtains smoother and improved performance of the washing machine. The microprocessor performs the last minute drain-out stage at 300 rpm.

Therefore, according to the present invention, the spinning operation includes the optional load first balancing cycle which untangles the load, the load weighing cycle which measures the load weight, the load balancing cycle which balances the load, and the main spinning cycle.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. A method of controlling a spinning operation of a washing machine, the method comprising:

measuring a first unbalanced distribution level of wet cloths contained within a tub while rotating the tub at a first speed;

interrupting the spinning operation of the washing machine when the first unbalanced distribution level is greater than a first predetermined value;

measuring a second unbalanced distribution level of the wet clothes while rotating the tub at a second speed selected from a resonance frequency range of the washing machine; and interrupting the spinning operation of the washing machine when a difference between the first and second unbalanced distribution levels is greater than a second predetermined value.

2. The method of claim 1, wherein the measuring a first unbalanced distribution level of wet clothes comprises:

measuring a speed variation of a motor that rotates the tub while rotating the tub at the first speed; and estimating the first unbalanced distribution level based upon the measured speed variation of the motor.

3. The method of claim 1, wherein the measuring a second unbalanced distribution level of the wet cloths comprises:

measuring a speed variation of a motor that rotates the tub while rotating the tub at the second speed; and estimating the first unbalanced distribution level based upon the measured speed variation of the motor.

4. The method of claim 1, wherein the interrupting the spinning operation of the washing machine comprises shutting off a power supply to a motor that rotates the tub for a predetermined time.

5. The method of claim 1, further comprising performing a main spinning cycle when the difference between the first and second unbalanced distribution levels is less than the second predetermined value, wherein a speed of the tub increases up to a third speed greater than the resonance frequency range.

6. The method of claim 1, wherein the first speed is lower than the resonance frequency range.

7. A method of controlling a spinning operation of a washing machine, the method comprising:

measuring a load weight of wet clothes contained in a tub to be spun;

determining an optimal acceleration rate based upon the measured load weight;

increasing a rotational speed of the tub to a first speed at the optimal acceleration rate in order to minimize unbalanced distribution of the wet clothes within the tub;

measuring a first unbalanced distribution level of the wet clothes while rotating the tub at the first speed;

interrupting the spinning operation of the washing machine when the first unbalanced distribution level is greater than a first predetermined value;

measuring a second unbalanced distribution level of the wet clothes while rotating the tub at a second speed selected from a resonance frequency range of the washing machine; and interrupting the spinning operation of the washing machine when a difference between the first and second unbalanced distribution levels is greater than a second predetermined value.

* * * * *